United States Patent [19]

Raymond

[11] Patent Number: 4,754,670

[45] Date of Patent: Jul. 5, 1988

[54] ADJUSTABLE EXTENSION TORQUE BAR

[76] Inventor: Walter E. Raymond, 4214 N. 27th Dr., Phoenix, Ariz. 85017

[21] Appl. No.: 849,347

[22] Filed: Apr. 7, 1986

Related U.S. Application Data

[63] Continuation-in-part of Ser. No. 683,809, Dec. 20, 1984, abandoned.

[51] Int. Cl.[4] ..... B25B 13/00

[52] U.S. Cl. ..... 81/177.2; 81/177.85

[58] Field of Search ..... 81/177.2, 177.85; 403/227, 104

[56] References Cited

U.S. PATENT DOCUMENTS

| | | | |
|---|---|---|---|
| 406,666 | 7/1889 | Pratt et al. | 81/177.7 |
| 2,438,633 | 3/1948 | Condor | 81/177.2 |
| 2,627,330 | 2/1953 | Gantz . | |
| 2,964,981 | 12/1960 | Blunt . | |
| 3,887,156 | 6/1975 | Hugonnier | 403/227 |
| 4,317,393 | 3/1982 | Graffain | 81/177 |
| 4,367,663 | 1/1983 | Merics | 81/177 |
| 4,376,397 | 3/1983 | Newby et al. | 81/177.2 |

FOREIGN PATENT DOCUMENTS

| | | | |
|---|---|---|---|
| 720,849 | 2/1932 | France | 403/227 |

*Primary Examiner*—Frederick R. Schmidt

*Assistant Examiner*—Maurina Rachuba

*Attorney, Agent, or Firm*—Harry M. Weiss & Associates

[57] ABSTRACT

An adjustable extension torque bar is provided which may be used to connect a driver member such as a wrench to a driven member such as a socket which engages a nut or bolt. The torque bar has an elongated member which slidably engages a noncircular aperture passing longitudinally along the length of an elongated sleeve. The aperture is noncircular in order to prevent the elongated member from rotating in the sleeve when torque is applied by a wrench which engages one end of the sleeve. The other end of the sleeve engages the elongated member which, in turn, engages the socket. An adjusting screw at one end of the elongated member may be tightened to cause a resilient spacer or a wedge-type member to expand against the inside surfaces of the noncircular aperture and prevent the elongated member from sliding inside the sleeve until sufficient force is applied to overcome frictional forces by pulling or pushing the elongated member with respect to the sleeve. The overall length of the torque bar may be established by first tightening the adjusting screw and then pulling or pushing the elongated member until the desired overall length is obtained. As such, the distance between the wrench and socket may be varied as necessary. An adjusting tool such as an Allen wrench may be used to tighten or loosen the adjusting screw.

7 Claims, 1 Drawing Sheet

ADJUSTABLE EXTENSION TORQUE BAR

This is a Continuation-In-Part of application Ser. No. 683,809, filed Dec. 20, 1984.

BACKGROUND OF THE INVENTION

This invention relates generally to extension torque bars and, more particularly, to an improved adjustable extension torque bar whose length may be easily and accurately varied to connect a driver member such as a wrench to a driven member such as a socket which engages a nut or bolt.

Very often a mechanic may have difficulty in tightening and loosening bolts, nuts, etc., in a confined area because there is insufficient room to move both the mechanic's hands and a wrench. This problem can often be solved by the use of an extension torque bar which interconnects the wrench to the nut or bolt to be torqued. However, since the distance between the wrench and each nut or bolt will vary, a number of fixed length torque bars are normally needed for each job. As a result, a mechanic may be required to carry numerous extension torque bars in his or her tool box or kit.

Many of these problems may be minimized through the use of an extension torque bar of variable length. Such an extension torque bar should be easy to use. A mechanic should be able to accurately adjust the length of the torque bar for each application. Adjustable length torque bars used in the past have been fabricated using a number of moving parts which inevitably leads to increased expense and necessary repairs as moving parts wear out or break. As a result, the number of parts used for an extension torque bar should be minimized in order to reduce fabrication costs and increase the working life of the torque bar. Any parts which wear out should be easily replaced.

Accordingly, there is a need for an improved adjustable extension torque bar of simplified design whose length may be easily and accurately adjusted to connect a driver member to a driven member.

SUMMARY OF THE INVENTION

Is an object of this invention to provide an improved extension torque bar whose length may be easily and accurately adjusted to connect a driver member such as a wrench to a driver member such as a socket which engages a nut or bolt.

It is still another object of this invention to provide an improved extension torque bar or simplified design using a minimum number of parts to reduce fabrication costs and increase the working life of the torque bar.

It is still another object of this invention to provide an improved extension torque bar made out of parts which may be easily replaced after they wear out.

In accordance with one embodiment of this invention, an adjustable extension torque bar is provided which may be used to connect a driver member such as a wrench to a driven member such as a socket which engages a nut or bolt. The torque bar has an elongated member which slidable engages a noncircular aperture passing longitudinally along the length of an elongated sleeve. The aperture is noncircular in order to prevent the elongated member from rotating in the sleeve when torque is applied by a wrench which engages one end of the sleeve. The other end of the sleeve engages the elongated member which, in turn, engages the socket.

An adjusting screw at one end of the elongated member may be tightened to cause a resilient spacer to expand against the inside surfaces of the noncircular aperture and prevent the elongated member from sliding inside the sleeve until sufficient force is applied to overcome frictional forces by pulling or pushing the elongated member with respect to the sleeve. The overall length of the torque bar may be established by first tightening the adjusting screw and then pulling or pushing the elongated member until the desired overall length is obtained. As such, the distance between the wrench and socket may be varied as necessary. A screw threaded into the sleeve engages the end of an elongated slot in the top of the elongated member preventing the member from sliding out of the sleeve. An adjusting tool such as an Allen wrench may be used to tighten or loosen the adjusting screw.

The foregoing and other objects, features and advantages of this invention will be apparent from the following, more particular, description of the preferred embodiments of the invention as illustrated in the accompanying drawings.

DESCRIPTION OF THE PREFERRED EMBODIMENT

Figure 1:
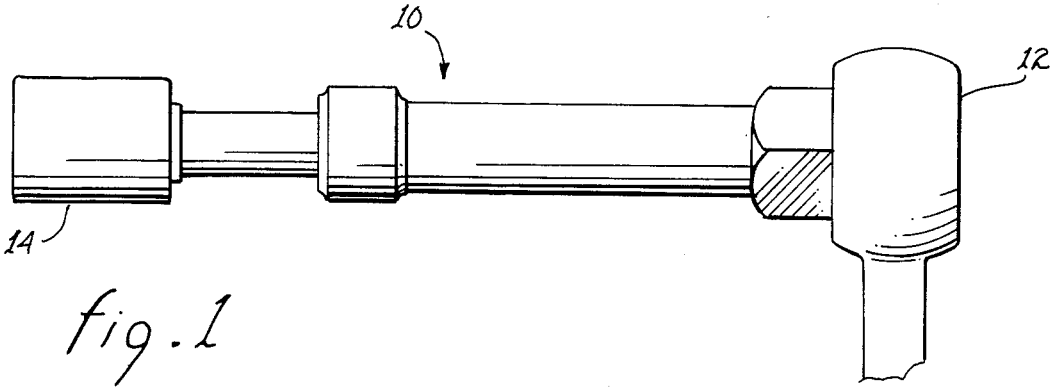
FIG. 1 is a plan view of an adjustable extension torque bar showing a wrench and socket engaging the ends of the torque bar.

FIG. 1 is a plan view of an adjustable extension torque bar, generally designated by reference number 10, showing a wrench 12 and adapter or socket 14 engaging the ends of the torque bar 10. An elongated member 18 slidably engages an elongated sleeve 20. The sleeve 20 has a noncircular aperture 22 passing longitudinally along its length. A driver member such as the ratched wrench 12 shown in FIGS. 1 and 2 engages aperture 22 at one end of the sleeve. It is important to note that a head 28 such as a hex head may be used to engage another type of wrench if desired. The elongated member 18 engages aperture 22 at the other end of the sleeve 20.

Figure 2:
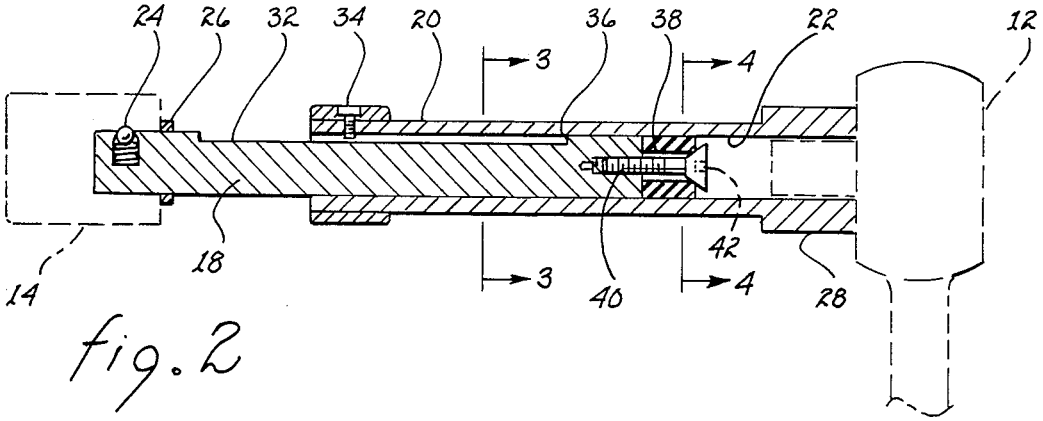
FIG. 2 is a longitudinal cross-sectional view of the adjustable extension torque bar with the wrench and socket shown by dashed lines.

As best shown in FIG. 2, the elongated member 18 engages the socket 14 or driven member using a spring ball 24 and ridge 26. Member 18 may be used without ridge 26 if desired. The socket 14 is used for the purpose of tightening or loosening a bolt, nut, etc.

Figure 3:
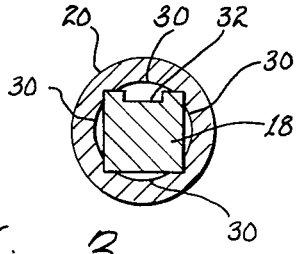
FIG. 3 is an enlarged cross-sectional view taken in the direction of the arrows 3—3 shown in FIG. 2.
Figure 4:
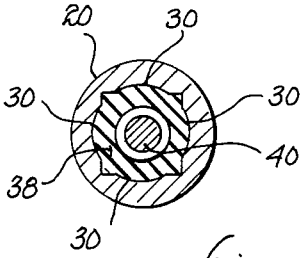
FIG. 4 is an enlarged cross-sectional view taken in the direction of the arrows 4—4 shown in FIG. 2.

As illustrated in FIG. 3, the elongated member 18 preferably has a square cross-section which slidably engages the sleeve 20. The aperture 22 is noncircular in order to prevent the enlogated member 18 from rotating in the sleeve 20 when torque is applied by the wrench 12. Preferably, the configuration of the aperture 22 is generally that of a square having curved surfaces 30 machined in each of its four sides as shown in FIGS. 3 and 4. However, any configuration which prevents the elongated member 18 from rotating may be used.

As shown in FIGS. 2 and 3, the elongated member 18 has an elongated slot 32 in its top surface. The slot 32 is used in conjunction with screw 34 to prevent the elongated member 18 from sliding out of the sleeve 20. This is accomplished by threading screw 34 into the sleeve 20 until it extends into the elongated slot 32. When the screw 34 is in this position, the elongated member 18 will not slide out of the sleeve 20 because the end of screw 34 will come into contact with end 36 of the elongated slot 32 as the elongated member 18 is pulled to the left. Note that the elongated member 18 may be removed from the sleeve 20 by simply unscrewing screw 34 until it no longer extends into slot 32.

Figure 5:
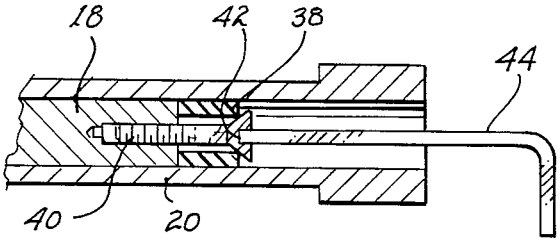
FIG. 5 is a partial cross-sectional view showing how an adjusting tool may be inserted into one end of the torque bar in order to turn the adjusting screw.

Another important feature of this invention involves the use of a resilient spacer 38 removably attached to the elongated member 18 by an adjusting screw 40 as shown in FIGS. 2 and 5. The resilient spacer 38 generally has the configuration of a cylinder. The outside diameter of the resilient spacer 38 is slightly smaller than one of the sides of the square which forms the configuration of aperture 22. In other words, the resilient spacer 38 is sized so that it both snugly fits inside and slidably engages aperture 22. If the configuration of aperture 22 is changed from that shown in FIGS. 3 and 4, then the size and shape of the resilient spacer 38 may be varied to fit the new configuration.

Referring again to FIGS. 2 and 5, the flexible spacer 38 has an inside diameter which allows the adjusting screw 40 to be inserted through the spacer. The adjusting screw 40 is then threaded into the end of the elongated member 18 attaching the spacer 38 to the member 18. The resilient spacer 38 may be removed from the elongated member 18 by simply unscrewing the adjusting screw 40.

The adjusting screw 40 has a frusto-conical-shaped head. As the screw 40 is tightened, its head bears against one end of the resilient spacer 38 causing the outer diameter of the spacer 38 near the head of the screw 40 to expand and come into contact with the inside surfaces of aperture 22. As the spacer 38 expands, its outside diameter deforms unit it fits into the curved inside surfaces 30 of aperture 22 as illustrated in FIG. 4. As such, surfaces 30 furnish additional surface to surface contact between the expanded spacer 38 and the inside surfaces of aperture 22.

Because the expanded spacer 38 is in contact with the inside surfaces of aperture 22, the elongated member 18 will not move until sufficient force is exerted to overcome frictional forces. The force is applied by simply pulling or pushing the elongated member 18 with respect to the sleeve 20. Therefore, after the spacer 38 has been expanded by the adjusting screw 40, the position of the elongated member 18 in relation to the sleeve 20 will remain fixed (the two parts will not slide) until the elongated member 18 is pulled or pushed. As a result, the overall length of the torque bar 10 may be established by first tightening the adjusting screw 40 until the resilient spacer 38 expands against the inside surfaces of aperture 22 and then pulling or pushing member 18 until the desired overall length is obtained. As such, the distance between the wrench 12 and socket 14 may be varied as necessary.

FIG. 5 shows how the adjusting screw 40 may be easily tightened or loosened by means of an adjusting tool such as an Allen wrench 44. The Allen wrench 44 fits into a depression 42 in the head of the screw 40.

The resilient spacer 38 is preferably made out of neoprene. However, any suitable material may be used. After the outside diameter of the resilient spacer 38 becomes worn due to repeated use, it may be easily replaced by simply unscrewing the adjusting screw 40. The remaining parts of the invention are preferably made out of steel, particularly a tool-type steel. However, any other materials having similar properties may be used.

Figure 6:
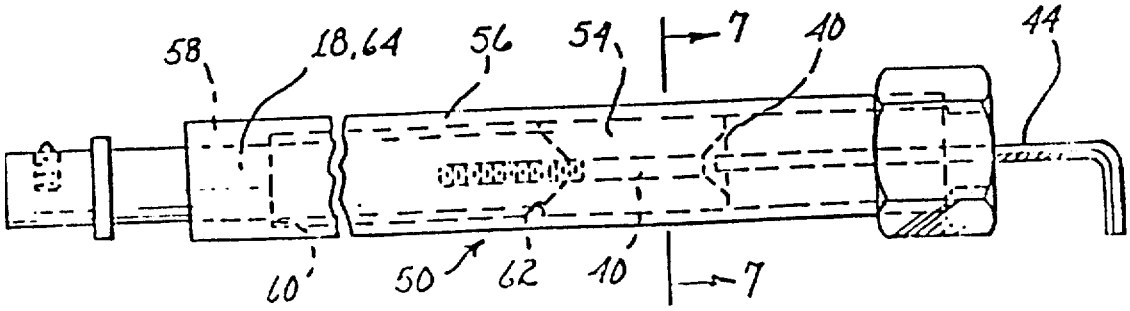
FIG. 6 is a longitudinal cross-sectional view of another embodiment of the adjustable extension torque bar of the present invention.

As shown in FIG. 6, another embodiment of the adjustable extension torque bar, now generally designated by the reference number 50 is illustrated having no elongated slot 32 in the elongated member 18, as previously discussed. Moreover, the threading screw 34 is not utilized. Further, the resilient spacer 38 is not used; rather, at least a pair of wedge-type members 54 (see FIG. 7, infra) are used thereof. The sleeve, now referred to by reference number 56, has an end portion 58 which has an internal ledge surface 60 to hold the first ends 62 when the elongated member, now referred to by reference number 64 is fully withdrawn or elongated relative to sleeve 56.

As further shown in FIG. 6, the end of the elongated member 64 which abuts the first ends 62 of the wedge-type members 54 are configured in a sloping protruding manner or chamfered, as shown, for proper fitting with the abutting wedge-type members 54.

Figure 7:
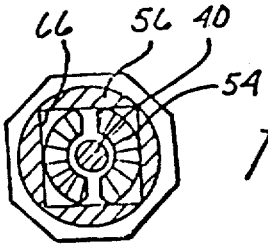
FIG. 7 is a cross-sectional view taken in the direction of the arrow 7—7 shown in FIG. 6.

In FIG. 7, a cross-sectional view taken along line 7—7 of FIG. 6 is shown to illustrate the wedge-type members 54 inside the sleeve 56 which has an internal surface 66 configured substantially like a square.

In a manner as previously discussed, the adjusting screw 40 is screwed by the Allen wrench 44 into the wedge-type members 54 for expanding thereto in order to impinge onto the internal surface 66 of the sleeve 56.

While the invention has been particularly shown and described in reference to preferred embodiments thereof, it will be understood by those skilled in the art that changes in form and details may be made therein without departing from the spirit and scope of the invention.

I claim:

1. An adjustable extension torque bar, comprising:

an elongated sleeve having a longitudinal noncircular aperture therein, said noncircular aperture exiting at first and second ends of said elongated sleeve, a driver member engaging said first end;

an elongated member having one end slidably engaging said noncircular aperture at said second end of said elongated sleeve, a driver member engaging the other end of said elongated member;

expandable means removably coupled to said one end of said elongated member for expanding outwardly to provide a friction type positioning of said elongated member within said elongated sleeve for adjusting the overall length of said torque bar, said expandable means comprises an outwardly expandable resilient spacer having a longitudinal aperture; and a screw having a frusto-conical-shaped head, said screw being inserted into said longitudinal aperture and threaded into said one end of said elongated member, said elongated member having an elongated slot positioned in the outside surface of said elongated member and having a spring ball being located at said other end of said elongated member, means cooperating with said elongated slot in said elongated member for preventing said elongated member from sliding out of said elongated sleeve, said screw cooperating with said resilient spacer to expand or contract said resilient spacer for adjusting the location of said elongated member within said sleeve.

2. The adjustable extension torque bar of claim 1 wherein said elongated sleeve has head means attached at said first end for engaging different wrenches.

3. The adjustable extension torque bar of claim 2 wherein said resilient spacer is made out of neoprene material.

4. The adjustable extension torque bar of claim 3 wherein said elongated sleeve and said elongated member are made out of tool-type steel.

5. An adjustable extension torque bar in accordance with claim 1 wherein said means for preventing said elongated member from sliding out of said elongated sleeve comprises a screw threaded into said elongated sleeve in a transverse direction perpendicular to the longitudinal axis of said elongated sleeve.

6. An adjustable extension torque bar comprising:

a hollow sleeve member;

an elongated rod member slidably engaging said hollow sleeve member, said elongated rod member having a square-shaped cross-section and an elongated slot;

an outwardly expanding flexible spacer means for providing a friction type positioning of said elongated rod member within said elongated sleeve member slidably engaging said hollow sleeve member, said flexible spacer having a longitudinal aperture; an adjusting screw passing through said longitudinal aperture and removably coupling said flexible spacer to said elongated rod member; and said screw cooperating with the flexible spacer for adjusting the location of said elongated rod member within said hollow sleeve member.

means for preventing said elongated rod member from sliding out of said hollow sleeve member, said means for preventing said elongated rod member from sliding out of said hollow sleeve member comprises a screw threaded into said hollow sleeve member.

7. An adjustable extension torque bar, comprising:

an elongated sleeve having a longitudinal noncircular aperture therein, said noncircular aperture exiting at first and second ends of said elongated sleeve, a driver member engaging said first end;

an elongated member having one end slidably engaging said noncircular aperture at said second end of said elongated sleeve, a driver member engaging the other end of said elongated member;

expandable means removably coupled to said one end of said elongated member for expanding outwardly to provide a friction type positioning of said elongated member within said elongated sleeve for adjusting the overall length of said torque bar, said expandable means comprises an outwardly expandable spacer having a longitudinal aperture; and a screw having a frusto-conical-shaped head, said screw being inserted into said longitudinal aperture and threaded into said one end of said elongated member, said elongated member having an elongated slot positioned in the outside surface of said elongated member and having a spring ball being located at said other end of said elongated member, means cooperating with said elongated slot in said elongated member for preventing said elongated member from sliding out of said elongated sleeve, said screw cooperating with said spacer to expand or contract said spacer for adjusting the location of said elongated member within said sleeve.

* * * * *

UNITED STATES PATENT AND TRADEMARK OFFICE

CERTIFICATE OF CORRECTION

PATENT NO. : 4,754,670

DATED : July 5, 1988

INVENTOR(S) : Walter E. Raymond

It is certified that error appears in the above-identified patent and that said Letters Patent is hereby corrected as shown below:

Please insert Figures 6 and 7 as shown on the accompanying drawings.

Signed and Sealed this

Twenty-second Day of November, 1988

*Attest:*

DONALD J. QUIGG

*Attesting Officer*

*Commissioner of Patents and Trademarks*

Patent No. 4,754,670

July 5, 1988

Walter E. Raymond